US008353642B2

(12) United States Patent
Munz et al.

(10) Patent No.: US 8,353,642 B2
(45) Date of Patent: Jan. 15, 2013

(54) SCREED FOR ROAD FINISHING MACHINE

(75) Inventors: Roman Munz, Neustadt (DE); Martin Buschmann, Neustadt (DE); Achim Eul, Mannheim (DE)

(73) Assignee: Joseph Vögele, Ludwigshafen (DE)

( * ) Notice: Subject to any disclaimer, the term of this patent is extended or adjusted under 35 U.S.C. 154(b) by 81 days.

(21) Appl. No.: 12/907,341

(22) Filed: Oct. 19, 2010

(65) Prior Publication Data

US 2011/0091278 A1 Apr. 21, 2011

(30) Foreign Application Priority Data

Oct. 20, 2009 (EP) ..... 09013219

(51) Int. Cl.
*E01C 19/22* (2006.01)

(52) U.S. Cl. ..... 404/118; 404/104

(58) Field of Classification Search ..... 404/118, 404/101, 105, 108, 114
See application file for complete search history.

(56) References Cited

U.S. PATENT DOCUMENTS

| | | | | |
|---|---|---|---|---|
| 4,129,399 | A * | 12/1978 | Ruge | 404/118 |
| 4,552,503 | A * | 11/1985 | Mouri et al. | 414/687 |
| 4,709,619 | A * | 12/1987 | Bartholomaus et al. | 92/130 D |
| 4,863,337 | A * | 9/1989 | Ishiguro et al. | 414/699 |
| 5,291,915 | A * | 3/1994 | Lukasczyk et al. | 137/82 |
| 5,301,769 | A * | 4/1994 | Weiss | 180/249 |
| 5,362,176 | A | 11/1994 | Sovik | |
| 5,484,227 | A | 1/1996 | Ikeda et al. | |
| 5,567,075 | A * | 10/1996 | Allen | 404/84.5 |
| 6,408,977 | B1 * | 6/2002 | Obertrifter et al. | 180/442 |
| 6,837,045 | B2 * | 1/2005 | Heusser | 60/403 |
| 8,001,776 | B2 * | 8/2011 | Wustefeld | 60/444 |
| 2001/0006019 | A1 * | 7/2001 | Deininger et al. | 91/508 |
| 2004/0101367 | A1 * | 5/2004 | Riedl | 404/113 |
| 2007/0199601 | A1 * | 8/2007 | Imhof | 137/625.64 |
| 2009/0133761 | A1 * | 5/2009 | Geissler et al. | 137/512.5 |
| 2010/0018198 | A1 * | 1/2010 | Rub | 60/422 |
| 2010/0186401 | A1 * | 7/2010 | Kauss et al. | 60/327 |

FOREIGN PATENT DOCUMENTS

| | | | |
|---|---|---|---|
| DE | 199211854 | U1 | 4/1994 |
| EP | 620319 | A1 | 10/1994 |
| WO | WO0223049 | A1 | 3/2002 |

* cited by examiner

*Primary Examiner* — Raymond W Addie
(74) *Attorney, Agent, or Firm* — Fish & Richardson P.C.

(57) ABSTRACT

In a screed with a basic screed and at least one extendable screed movable relative to the basic screed with a hydraulic cylinder and an electro-hydraulic control comprising a magnet-actuated directional control valve for at least controlling the direction of the hydraulic cylinder, the directional control valve for changing the rate of motion of the hydraulic cylinder is guided by an operator or automatically and is a proportional directional control valve (W) with proportional-electric direct actuation or proportional-electric-hydraulic pilot control. The proportional directional control valve for the hydraulic cylinder is connected on the actuation side with an electro-hydraulic control of a hydraulic system of the road finishing machine.

10 Claims, 3 Drawing Sheets

Figure 4:
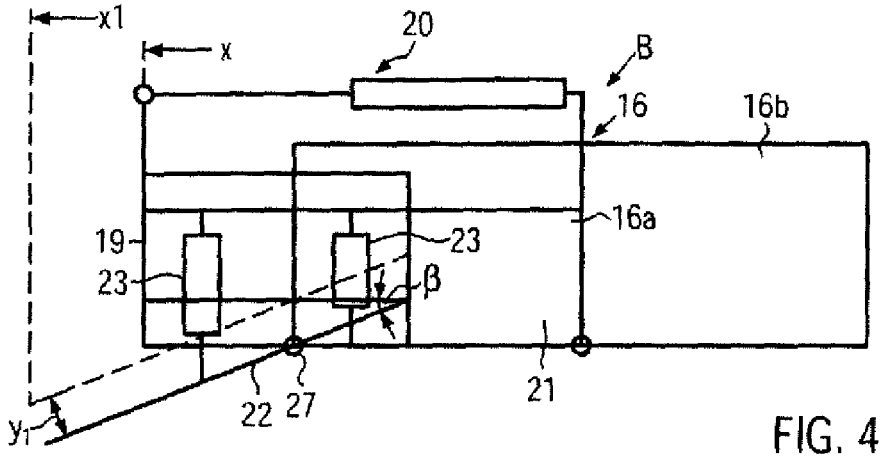

FIG. 1
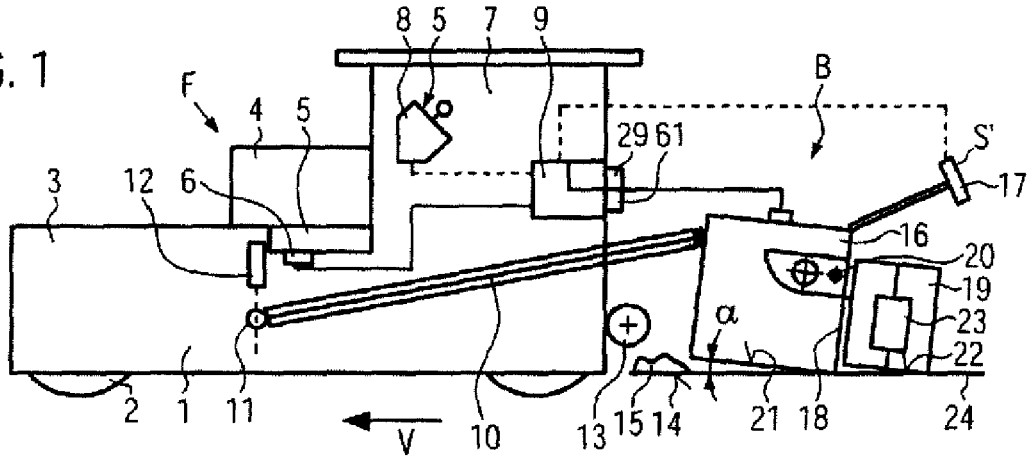
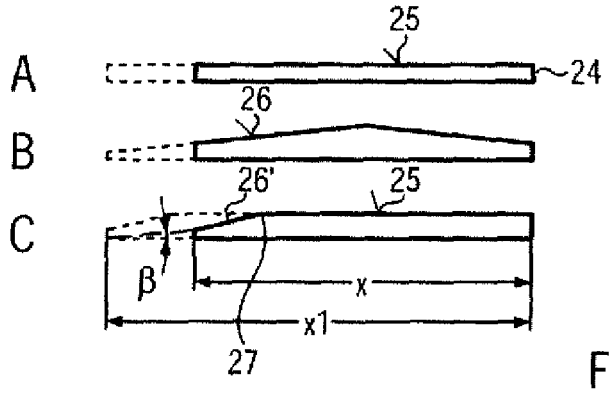
FIG. 2
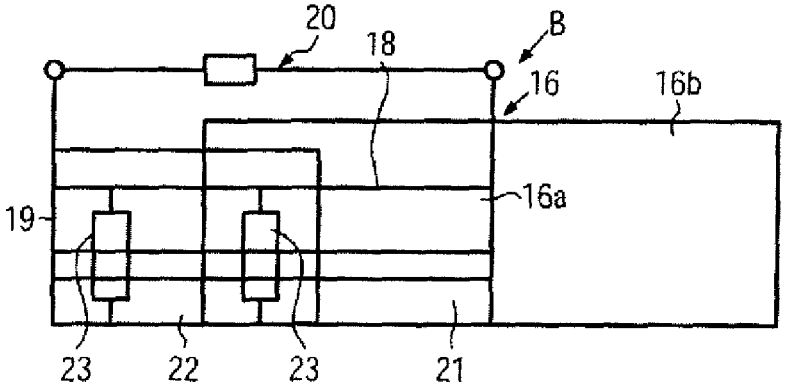
FIG. 3

SCREED FOR ROAD FINISHING MACHINE

The invention relates to a screed for road finishing machines having a basic screed comprising at least one screed plate and at least one extendable screed comprising at least one screed plate, which is arranged at the same to be movable relative to the basic screed by means of at least one hydraulic cylinder which can be acted on from both sides for changing the working width of the screed, and having an electro-hydraulic control as well as to a road finishing machine with a screed comprising extendable screeds movable by hydraulic cylinders wherein the electro-hydraulic control is in actuating connection with proportional magnets of at least one proportional directional control valve of the screed functionally associated to one hydraulic cylinder each in the screed to adapt the rate of motion of the hydraulic cylinder to at least one laying parameter.

During the laying of pavements of laying material with a screed floatingly towed by the road finishing machine on the laying material at a laying speed dictated by the road finishing machine, one has to consider laying parameters which require adaptation adjustments to be made at the screed and its movable extendable screeds. For the directional control of each hydraulic cylinder moving an extendable screed relative to the basic screed, up to now the so-called black-and-white directional control valve technique has been employed, i.e. a directional control valve with a black-and-white switching magnet (lifting magnet) which, in a powered state, assumes one switching position without intermediate positions and generates a certain magnetic force, in a non-powered state, however, assumes another switching position without generating a magnetic force. The directional control valve either opens at least one flow path completely or closes the same depending on the switching position of the black-and-white magnet. This results in a rate of motion of the hydraulic cylinder in the respective direction of motion predetermined by the hydraulic flow rate. The flow rate can be changed by additional hydraulic measures upstream or downstream of the directional control valve. However, with the black-and-white valve technique common up to now in screeds, no continuous change or adaptation of the rate of motion of the hydraulic cylinder is possible.

The road finishing machine known from EP 0 620 319 A has one solenoid valve in the screed for each hydraulic cylinder of the extendable screed, the solenoid valve being switched by a controller to extend the extendable screed, retract it or hold it in position. The solenoid valve is a directional control valve for the hydraulic cylinder whose rate of motion exclusively depends on the discharge pressure or the adjusted discharge flow rate (quantity per time unit) provided by the hydraulic system of the road finishing machine. An individual adaptation of the rate of motion of the hydraulic cylinder is not possible with a solenoid valve (passage position/shut-off position).

The road finishing machine known from U.S. Pat. No. 5,362,176 A comprises a 4/3-way directional control valve in the screed for the hydraulic cylinder of the extendable screed which can be adjusted between its three switching positions by means of two switching magnets. The switching magnets (black-and-white magnets, i.e. completely powered: on; not powered: off) are actuated by a control via relays. The rate of motion of the hydraulic cylinder exclusively depends on the discharge pressure or the discharge rate of a hydraulic pump; but it cannot be individually controlled via the 4/3-way directional control valve.

A predetermined rate of motion of the hydraulic cylinder is, for example, disadvantageous in the following laying situations:

a) The precise formation of a joint not extending in the direction of motion or of a lateral termination of the pavement requires a relatively slow rate of motion or precise changes of the rate of motion of the hydraulic cylinder at least of one extendable screed.

b) A lateral connection of a street or bypassing an obstacle by moving the extendable screed requires, depending on the laying speed, a possibly high rate of motion and a precisely controllable speed development of the hydraulic cylinder.

c) During the laying of a pavement with a shoulder inclined to the outside (slope) by laterally inclining the screed plate of the extendable screed, a sudden change of level between the screed plate of the extendable screed and the screed plate of the basic screed occurs when the extendable screed is being extended, which sudden change of level has to be compensated e.g. by lowering the screed plate of the extendable screed in parallel in order not to form a step in the surface or not to laterally shift the transition from the roadway to the shoulder. For example by using a reference rail, which represents the level and lateral inclination of the screed plate of the extendable screed, and a sensor at the basic screed which scans the reference rail, the sudden change of level arising during the extension could be measured and at least theoretically compensated by controlling height adjustments of the screed plate of the extendable screed. As normally, however, height adjustment is performed at a constant and relatively low speed at the screed plate of the extendable screed and the arising sudden change of level depends on the shoulder angle which can be varied, with the given relatively high moving speed of the extendable screed, the sudden change of level is often overcompensated or undercompensated. The formation of a longitudinal step in the surface of the pavement and/or the lateral course of the transition from the roadway to the shoulder cannot be avoided, even if one tries to move the hydraulic cylinder only step by step. This requires rectifications.

The object underlying the invention is to provide a screed as well as a road finishing machine in which it is possible to adapt the rate of motion of the hydraulic cylinder for moving the extendable screed during the laying of a pavement to certain and possibly varying laying parameters.

This object is achieved with the screed for road finishing machines described herein.

The use of a proportional directional control valve, either with a proportional-electric direct actuation or a proportional-electric-hydraulic pilot control, permit to precisely change the rate of motion of the hydraulic cylinder and thus the moving speed of the extendable screed relative to the basic screed guided by an operator or even automatically, or to adapt it at least to one laying parameter, as in the proportional valve technique, the rate of motion of the controlled hydraulic cylinder always exactly corresponds to the current feed to the proportional magnet or has a precisely predeterminable proportionality to the current feed. Depending on the current feed, proportional magnets generate a certain development of the magnetic force or the magnetic lift, and in contrast to black-and-white actuation magnets, they do not only switch between switching positions. The proportional valve technique thus permits to very slowly traverse the respective extendable screed in the screed for the precise formation of a joint that does not extend in the direction of the working motion or of a lateral termination, or to change the rate of motion correspondingly precisely with a certain profile, and to nevertheless move the extendable screeds as quickly or as slowly as possible for the basic adjustment of the working width of the screed. If a lateral connection of a street is to be included in the pavement, or if an obstacle must be bypassed at a certain laying speed, the rate of motion for the respective extendable screed can be precisely varied as required with the proportional valve technique. If during the laying of a shoulder in the pavement at a constant speed of the height adjustment of the screed plate of the extendable screed, the sudden change of level during the movement of the extendable screed is to be compensated automatically, the rate of motion of the hydraulic cylinder and thus of the extendable screed can be controlled for example exactly depending on the adjusted shoulder angle such that neither a longitudinal step is formed nor the transition from the roadway to the shoulder drifts off laterally.

With the equipment of the respective proportional directional control valve, the road finishing machine comprises electro-hydraulic prerequisites for the screed comprising extendable screeds that can be connected as implement, which prerequisites permit to precisely control, or change the moving speed of each extendable screed, or to adapt it to certain laying parameters. This results in a high quality of laid pavements even under difficult laying conditions.

Though the proportional valve technique has been common for decades in mobile hydraulics e.g. in crane controls, pole controls of concrete pumps, hoisting platforms, in industrial trucks and the like, it has not been applied for screeds of road finishing machine due to the higher costs, the complex electric control, and a presumed susceptibility to malfunctions under the extreme working conditions in a screed or a road finishing machine, also because the operators of road finishing machines have been specially trained to handle certain laying parameters and to compensate the restrictions given by the black-and-white valve technique with improvisations and their experience.

The proportional valve technique especially for the hydraulic cylinders of the extendable screeds in the screed is appropriate not only for the non-restricting selection of the listed laying situations, but for all applications where a precise adjustment and change of the rate of motion is required at the screed which, though being towed by the road finishing machine, forms a separate operation unit, to keep the quality of the laid pavement as constant and as high as possible despite varying or only occasionally occurring laying situations. The proportional valve technique is compatible with a fixed displacement pump or a variable capacity pump pressure supply, where in a fixed displacement pump system, an unpressurized circulation (via a circulation valve or by the proportional directional control valve) can be provided when no hydraulic load is actuated. Finally, the proportional valve technique in the screed also offers the advantage of being able to conveniently master automatic operating sequences via control systems. As operation in the screed work is performed at considerable operating pressures, e.g. 200 bar or more, and with large flow rates of for example 60 l/min, for a proportional-electric direct actuation of the directional control valve, relatively large, powerful proportional magnets are required, so that it can be appropriate to employ proportional directional control valves with a proportional-electro-hydraulic pilot control, as for a proportional pilot control, possibly lower pressures and only low quantities of pressurizing agents are to be mastered, for which small and weaker, and thus cheaper, proportional magnets are sufficient.

In one appropriate embodiment of the screed, via the activation of the proportional magnet, the rate of motion of the hydraulic cylinder is adjusted proportionally to a given rate of motion of at least one further extendable screed component, for the function of which the movement of the extendable screed is important. For example, the rate of motion of the hydraulic cylinder is adjusted proportionally to the rate of motion of a height and/or lateral inclination drive of the screed plate of the extendable screed which generates an essentially constant rate of motion. For adaptation, this requires a sensitive variation of the rate of motion of the hydraulic cylinder, for example depending on the lateral inclination angle of the screed plate of the extendable screed to simultaneously compensate a misalignment during the movement.

In one appropriate embodiment, the rate of motion of the hydraulic cylinder can be varied and maintained load-independently. This is because the proportional valve technique can be particularly easily combined with hydraulic measures leading to load independence. This is advantageous as the kinetic resistance of the extendable screed depends, for example, on the extension stroke, wear, the condition of the subsoil, the consistency of the laying material, environmental conditions and the like, and because it can vary. Thanks to the load independence in the control of the rate of motion of the hydraulic cylinder, these influences cannot falsify the rate of motion predetermined by the current feed to the proportional magnet.

The proportional valve technique for the hydraulic cylinders of the extendable screeds is advantageously inserted in a screed in which hydraulic cylinders and/or spindle drives driven at a predetermined rate of motion with hydraulic or electric motors for adjusting the height and/or the lateral inclination of the screed plate of the extendable screed at least relative to the screed plate of the basic screed are provided. Thanks to the proportional valve technique for the hydraulic cylinders of the extendable screed movement, the given rate of motion of such drives has no longer any disadvantageous effect in the adaptation to certain laying parameters or varying laying situations. The height and/or lateral inclination adjustment of the screed plate of the extendable screed can here be effected in different ways. In one embodiment, the complete guide system for the extendable screed is adjusted relative to the basic screed for adjusting the lateral inclination. In another embodiment, the guide on which the extendable screed is moved is fixed in the basic screed in parallel to the screed plate of the same. The screed plate of the extendable screed is only adjusted relative to the extension guide, either as to its level as well as to its lateral inclination, or only as to its level, the lateral inclination then being changed by an additional adjustment drive.

For the proportional directional control valve, several designs offer themselves. For example, the proportional directional control valve can be embodied as seat valve or as sliding valve. A seat valve is characterized by a leakage-free shut-off position and exactly predictable operating forces. A sliding valve permits very precise control but inevitably involves leakage. As a further alternative, the proportional directional control valve could also be a two-way or a three-way flow control valve which works with a control screen adjusted by the proportional magnet directly or via pilot control.

In one appropriate embodiment, in a control block of the electro-hydraulic control associated to the screed, a 4/3-way proportional pressure control valve, preferably in a sliding design and with the zero position being open to the tank, with two proportional magnets for direct actuation acting in opposite directions is provided between two working ports and a pressure source with an associated tank at least for the respective hydraulic cylinder moving the extendable screed. The control block contains a minimum number of hydraulic or electro-hydraulic components for each hydraulic cylinder.

In another embodiment, two 3/2-way proportional pilot control pressure control valves with one proportional magnet each, preferably in a sliding design, and a hydraulically pilot-controlled 4/3-way pressure control valve, preferably in a sliding design and with the neutral position being open to the tank, are provided between two working ports and a pressure source with an associated tank in a control block of the electro-hydraulic control associated to the screed at least for the respective hydraulic cylinder moving the extendable screed, each 3/2-valve being associated to a pressure pilot control of the 4/3-valve. While in this control block more hydraulic or electro-hydraulic components are required than in the other embodiment, small and cheaper proportional magnets can be used.

Appropriately, a pressure scale is associated to the 4/3-valve on the pressure side, and one load holding valve each on the side of the working port, where the two load holding valves can be controlled crosswise. The pressure scale permits to operate the proportional directional control valve load-independently, as the pressure scale keeps the pressure difference adjusted at the proportional directional control valve by the current feed to the proportional magnet constant independent of fluctuations of the supply pressure or the working pressure in the hydraulic cylinder, and thereby keeps the rate of motion of the hydraulic cylinder constant. The load holding valves generate a hydraulic blocking of the hydraulic cylinder in the respectively adjusted sliding position and immediately abandon their load holding function depending on the pressure if a movement of the hydraulic cylinder is activated.

Appropriately, on the opening control side, a control spring and a load pressure signal preferably measured via a shuttle valve act on the pressure scale, and on the closing control side, the supply pressure of the 4/3-valve acts on the pressure scale. In this manner, the pressure scale can detect changing pressure conditions in the hydraulic cylinder or at the pressure source and correspondingly perform control. This is also appropriate if several hydraulic loads are supplied and controlled from one common pressure source.

For safety reasons, at least one working port of the hydraulic cylinder should be secured by a pressure limiting valve to the tank which performs, for example, a shock valve function if the extendable screed unintentionally drives against an obstacle or a stop.

In one appropriate embodiment, the control block comprises, apart from the proportional directional control valves of the hydraulic cylinders for moving the extendable screed, also magnet-actuated directional control valves associated to further hydraulic loads in the screed, such as the hydraulic cylinders and/or hydraulic motors for adjusting the height and/or lateral inclination of the screed plate of the extendable screed, and the control block is connected to a common pressure source and also to a common electro-hydraulic control. The pressure source, the tank and the electro-hydraulic control can be located in the road finishing machine, just as the control block. At least the control block could, as an alternative, also be accommodated in the screed.

Appropriately, electric proportional amplifiers are associated to the proportional magnets in the electro-hydraulic control, the advantages of the amplifiers being that they keep the current fed to the proportional magnet constant independent of the supply voltage and of heat-related resistance variations of the coil of the proportional magnet. Furthermore, this results in a better EMC characteristic and in possible applications within a wide temperature range.

In one appropriate embodiment, the electro-hydraulic control comprises a preferably selectively activated automatic control section for linking the control of the proportional magnet with the movement control of a further extendable screed component movement. The automatic control section for example then adjusts the current feed to the respective proportional magnet in precise association to a movement control of the further extendable screed component to effect an individual adaptation to a given laying situation. As an alternative, the current feed to the proportional magnet and the control of the further movement can be linked on the operator's side. The control of movements in the screed can be performed by the road finishing machine and/or for example an external control stand at the screed, e.g. even wirelessly, e.g. by radio transmission or the like, by an operator remote from the road finishing machine and the screed, or possibly even from the internet, for example using Bluetooth or WLAN techniques. At least the electric or electronic components, such as the proportional magnets, and optionally provided feedback sensors, can be incorporated in a bus system, e.g. a CAN-bus, of the road finishing machine.

Figure 5:
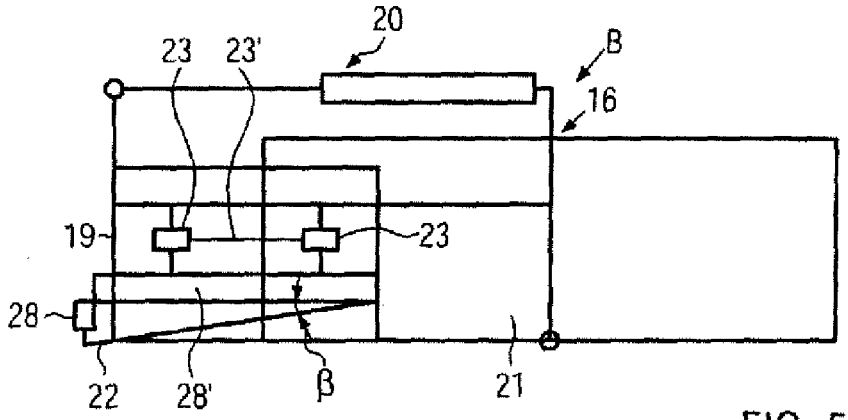
Figure 6:
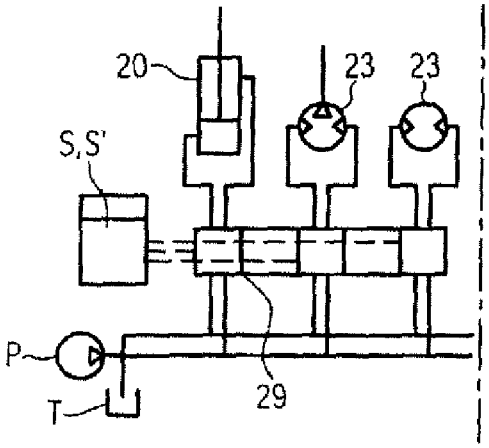
Figure 7:
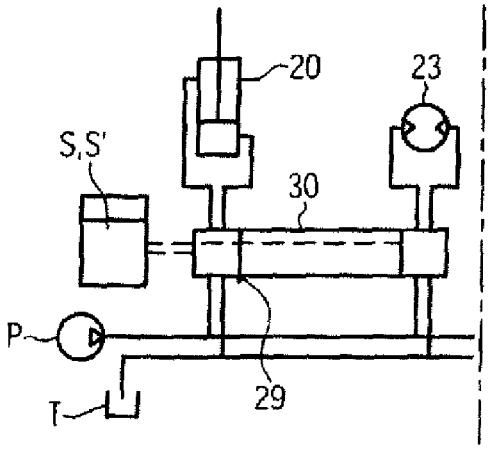
Figure 8:
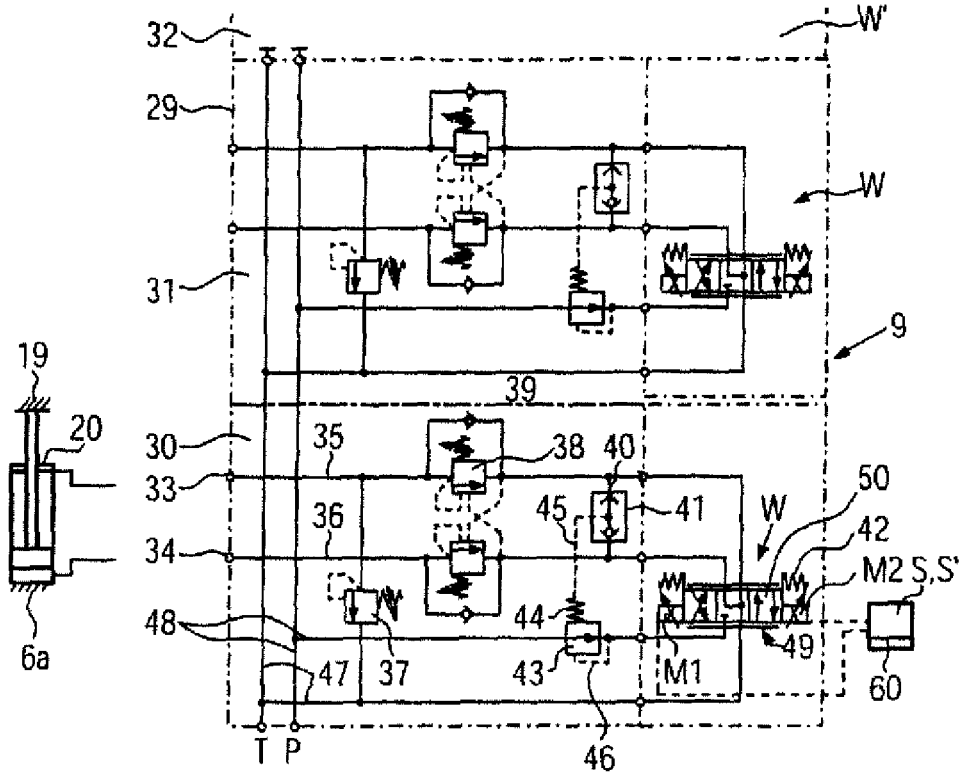

With reference to the drawings, embodiments of the subject matter of the invention will be illustrated. In the drawings:

FIG. 1 shows a schematic side view of a road finishing machine with a screed during the laying of a pavement, FIGS. 2A, B, C show various examples of pavements to be laid, FIG. 3 shows a schematic front view of a part of an embodiment of a screed in a laying situation, FIG. 4 shows the embodiment of FIG. 3 in another laying situation, FIG. 5 shows a schematic front view of a part of another embodiment of a screed, FIG. 6 shows a schematic control system for the embodiment of the screed of FIGS. 3 and 4, FIG. 7 shows a schematic control system for the embodiment of the screed of FIG. 5, FIG. 8 shows a block diagram of a control block, matching to FIGS. 3 to 5, and FIG. 9 shows a block diagram of a control block of another embodiment, matching to FIGS. 3 to 5.

FIG. 1 schematically illustrates a road finishing machine F with a screed B during the laying of a pavement 24 of laying material 15 on a subsoil 14, the road finishing machine F driving at a laying speed V.

The road finishing machine F comprises a chassis 1 with a running gear 2 and a bunker 3 for laying material on the front side. A primary drive source, e.g. a diesel motor 4, is arranged in the chassis 1 behind the bunker 3, the drive source driving at least one hydraulic pump 6 via a pump power divider 5, the hydraulic pump 6 supplying a hydraulic system 9 in which at least one control block with at least one non-depicted proportional directional control valve is arranged. The screed B is connected with tow bars 10 which are connected to tow points 11 of the chassis 1. The height of the tow points 11 can be adjusted by hydraulic motors 12. The road finishing machine F comprises a driver stand 7 with a control panel 8 in which at least a part of an electro-hydraulic control S for the screed B can be placed. At the rear end of the chassis 1, a lateral distribution device 13 for the laying material 15 conveyed from the bunker 3 to the rear and discharged onto the subsoil 14 is provided. From the laying material 15, the screed B forms the pavement 24 with a certain pavement thickness which can vary in the direction of motion or else transverse to the direction of motion. The laying material 15 is compacted and flattened in the laid pavement 24 (by non-depicted initial compaction and/or high compaction devices of the screed B).

The screed B comprises a basic screed 16 of a certain width to which, for example, an external control stand 17 can be attached. The external control stand 17 can also contain a similar or equal electro-hydraulic control S'. The electro-hydraulic controls S, S' are connected with the hydraulic system 9 and serve to e.g. hydraulically actuate movable working components of the screed B.

At the basic screed 16, guide means 18 fixed to the basic screed are provided, on which extendable screeds 19 are arranged to reciprocate relative to the basic screed 16 and transversely to the direction of the working motion. For moving each extendable screed 19, at least one hydraulic cylinder 20 is provided which is supported in the basic screed 16 on the one hand and in the extendable screed 19 on the other hand. The hydraulic cylinders 20 serve to change the working width of the screed B or of the laid pavement 24. The basic screed 16 has at least one screed plate 21 which rests on the laying material 15. Each extendable screed 19 also has at least one screed plate 22. The screed B is appropriately set with a positive setting angle α relative to the subsoil 14, while it is being floatingly towed on the laying material 15. The setting angle α for example determines the pavement width of the pavement 24. In each extendable screed 19, height and/or lateral inclination adjustment means 23 for the screed plate 22 of the extendable screed are contained to adjust the height of the screed plate 22 of the extendable screed relative to the guide means 18 and/or incline it laterally to the direction of motion (a lateral inclination is required if the extendable screed 19 lays a lateral shoulder in the pavement 24). The means 23 can comprise hydraulic cylinders or hydraulic motors as drives which are supplied by the hydraulic system 9, or electric motors. Usually, the actuated means 23 generate an essentially constant rate of motion of the screed plate 22 of the extendable screed.

The pavement 24 in FIG. 2A has an at least essentially flat upper side 25 over the working width. In FIG. 2B, the pavement 24 has a transverse camber 26 (for this, according to FIGS. 3 to 5, the basic screed 16 is divided into two basic screed parts 16*a*, 16*b*, bendable relatively to each other). In FIG. 2C, the pavement 24 has a flat upper side part 25 (or a transverse camber 26, not shown), e.g. as roadway, and a lateral shoulder 26' inclined downwards (slope) which is inclined starting from a transition 27 at an angle β to the outer edge of the pavement 24. In FIGS. 2A, 2B, 2C, X and X1 indicate different working widths. The working width is changed by actuating at least one of the hydraulic cylinders 20 for moving at least one of the extendable screeds 19.

If in the pavement 24 in FIG. 2C, the working width is enlarged from X to X1, the transition 27 (the width of the roadway) must be maintained by controlling the means 23 and the hydraulic cylinders 20, and only the width of the shoulder 26' is to enlarge. The changes of the working width indicated in FIGS. 2A to 2C can also be controllable when an obstacle is bypassed or when a joint or a lateral termination is formed.

FIG. 3 shows the screed B (a part of it) in a schematic view in the direction of motion. The basic screed 16 consists of two basic screed parts 16*a*, 16*b* having the same widths which can be, for example, bent relatively to each other (not represented more in detail) to optionally form the transverse camber 26 of FIG. 2B or the flat upper side 25 of FIG. 2A or FIG. 2C. The guide means 18 fixed to the basic screed extend in parallel to the screed plate 21 of the basic screed and in shifting motions guide the extendable screed 19 controlled by the hydraulic cylinder 20 in a moving direction fixed with respect to the basic screed. Per extendable screed 19, for example two height and/or lateral inclination adjustment means 23 (with hydraulic cylinders, spindle drives with hydraulic motors or electric motors, or the like) are provided to be able to adjust the level of the screed plate 22 of the extendable screed relative to the screed plate 21 of the basic screed, which becomes necessary if, for example, the setting angle α shown in FIG. 1 is changed, as the extendable screed 19 mounted to the rear of the basic screed 16 has a greater distance from the tow point 11 than the basic screed 16 and moves in a different way than the same. The screed in FIG. 3 lays the pavement 24 of FIG. 2A for example with the basic screed 16 and the partially extended extendable screed 19.

FIG. 4 illustrates that the height adjustment and/or lateral inclination adjustment means 23 for the screed plate 22 of the extendable screed can also be used for adjusting the lateral inclination of the screed plate 22 of the extendable screed with the angle β of the shoulder 26' if the pavement 24 of FIG. 2C is laid. To hold the transition 27 stationary, with a set angle β, when the working width is enlarged e.g. from X to X1, the then occurring sudden change of level Y1 of the screed plate 22 of the extendable screed with respect to the screed plate 21 of the basic screed must be compensated by lowering the screed plate 22 of the extendable screed in parallel to itself. For the transition 17 to remain stationary in the transverse direction relative to the basic screed 16, at the given rate of motion of the height adjustment of the screed plate 22 of the extendable screed, the rate of motion of the hydraulic cylinder 20 must be adapted depending on the angle β. For this reason among others, and also for bypassing obstacles or forming precise joints or terminations, therefore the proportional valve technique is employed for the screed B to control the rate of motion and/or the direction of motion of the hydraulic cylinder 20, as is illustrated with reference to FIGS. 8 and 9.

In FIG. 5, the means 23 only serve for the height adjustment 22 of the screed plate of the extendable screed or of an intermediate frame 28' relative to the screed plate 21 of the basic screed (for example by means of a common drive 23'). A lateral inclination of the screed plate 22 of the extendable screed with the angle β can be selected by a further, separate drive 28 relative to the intermediate frame 28'. If the working width is enlarged from X to X1, the means 23 or the drive 23' is adjusted at an essentially constant rate of motion of the screed plate 22 of the extendable screed or the intermediate frame 28', so that for holding the transition 27 stationary, the rate of motion of the hydraulic cylinder 20 must be adapted depending on the size of the selected angle β. For this, too, the proportional valve technique is employed for speed control.

The electro-hydraulic control S, S' for the screed B of FIGS. 3 and 4 is schematically indicated with reference to FIG. 6 in connection with at least one control block 29 per screed half to which a common pressure source P and an associated tank on the one hand, and the respective hydraulic cylinder 20 as well as the drives of the means 23 are connected.

FIG. 7 illustrates the linkage of the electro-hydraulic control S, S' with a control block 29, per screed half, in which the respective hydraulic cylinder 20 as well as the drive 23' of the screed B of FIG. 5 are connected. In the control blocks 29 of FIGS. 6 and 7, at least for the speed control of the hydraulic cylinders 20, the proportional valve technique is employed, as is illustrated with reference to FIGS. 8 and 9.

The control block 29 shown in FIGS. 1, 6 and 7 can be placed in the road finishing machine F, for example, in the hydraulic system 9 and connected to the screed B and at least the hydraulic cylinder 20 via couplings 61 and hydraulic lines. The control block 29 could be located at a suited site in the screed B or even directly at the respective hydraulic cylinder 20. The control block 29 can be assembled from individual sections in plate, row or block assembly, as is illustrated, for example, with reference to FIGS. 8 and 9, or it can be assembled modularly of individually mounted hydraulic components.

In the illustrated embodiments of the screeds B, the extendable screeds 19 are mounted at the rear side of the basic screed 16 in the direction of the working motion (rear mount). The proportional valve technique, however, can also be employed in screeds for the hydraulic cylinders where the extendable screeds are mounted at the front side of the basic screed (front mount).

The control and/or electric or electronic monitoring of the proportional directional control valve W or of proportional magnets can be performed via a bus system common today in a road finishing machine, e.g. a CAN bus, ensuring high functionality and operational reliability, optionally in connection with corresponding sensors and their information.

In FIG. 8, the control block 29 comprises at least three assembled sections 30, 31 and 32, the sections 30 and 31 containing proportional directional control valves W for at least the two hydraulic cylinders 20 of the screed B, and in the further section 32 not shown in detail, for example black-and-white magnetic directional control valves W' can be provided for controlling other hydraulic loads, as the means 23, 23' and 28, and the like of FIGS. 3 to 7.

As the sections 30, 31 essentially have the same design, only section 30 is illustrated. The section 30 comprises two working ports 33, 34 for the hydraulic cylinder 20 which is arranged between the extendable screed 19 and the basic screed part 6*a*. Working lines 35, 36 lead from the working ports 33, 34, to the proportional directional control valve W, the working line 35 being secured via an adjustable pressure limiting valve 37 to a tank line 47 connected to a tank T, and in both working lines, load holding valves 38 with a hydraulic opening control with bypassing check valves 39 are arranged in this embodiment, and a shuttle valve 41 is arranged between the working lines 35, 36 in a cross connection 40 which serves for picking up a load pressure signal. The tank line 47 extending through the sections 30, 31, 32 is connected to the proportional directional control valve W in the respective section, just as is a pump line 48 (pressure source P) common to all sections. In the section of the pump line 48 associated to the section 30, as admission control, a pressure scale 43 can be arranged on the adjustable pressure scale member whose control spring 44 acts in the opening control direction (for opening the passage) as well as in parallel to the control spring 44 from a control line 45 with the load pressure signal from the shuttle valve 41, however the supply pressure of the proportional directional control valve W acts on it in the closing control direction (until it is shut off) from a control line 46.

The proportional directional control valve W is in FIG. 8 a multiway-multiposition sliding valve with proportional-electric direct actuations by oppositely acting proportional magnets M1, M2 which directly act on a valve element 50 (e.g. a sliding piston), namely in parallel to springs 42 which adjust e.g. the shown neutral position. Concretely, this is a 4/3-way proportional pressure control valve 49 (the pressure control function is indicated by the parallel lines in the symbolic representation) in a sliding design with the neutral position being open to the tank for both working lines 35, 36. The proportional magnets M1, M2 are connected, for example, to the electro-hydraulic control S, S' (in the road finishing machine and/or in the external control stand 17), where the electro-hydraulic control S, S' can comprise an automatic control section 60 or be connected with the same, which serves for linking the electric activation of the proportional magnets M1, M2 with a control of a further extendable screed component movement, e.g. the means 23, 23' in section 32 of the control block 29, e.g. to adjust the hydraulic cylinder 20 at a rate of motion selected for example depending on the other rate of motion. The electro-hydraulic control S, S' basically permits the directional and speed control of each hydraulic cylinder 20, the latter with a change of the speed directly depending on the current feed to the respective proportional magnet M1, M2.

The proportional directional control valve W load-independently controls the hydraulic cylinder 20 as the pressure scale 43 keeps the pressure difference adjusted by the current feed to the respective proportional magnet M1, M2 constant via a slide valve 50 independent of whether the supply pressure (pressure source P) and/or the working pressure in the respective working line 35, 36 varies, so that always exactly the quantity of hydraulic medium per time unit corresponding to the current feed to the proportional magnet M1 or M2 flows and determines the rate of motion of the hydraulic cylinder 20.

The proportional directional control valve W (4/3-way directional control valve 49) is shown in FIG. 8 as integrally formed sliding valve. The same function could be achieved in two proportional directional control valves. The proportional directional control valve W could also be embodied as seat valve or as a one- or two-way or a three-way proportional flow control valve (not shown).

Figure 9:
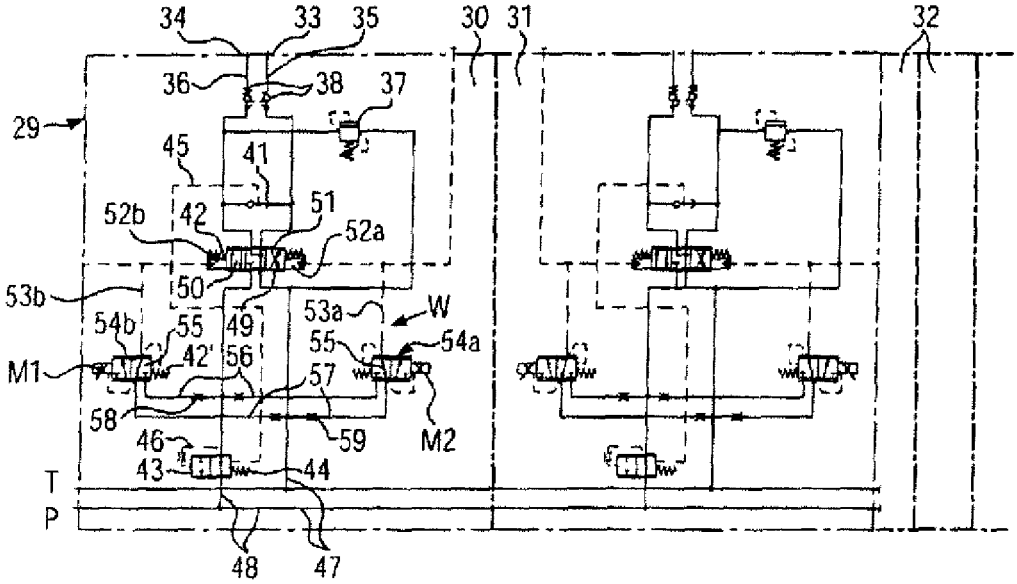

The control block 29 shown in FIG. 9 contains a different design of the proportional directional control valve W for the same functions. That is, the 4/3-way pressure control valve 51 has hydraulic pilot controls 52*a*, 52*b* for its sliding piston 50 which are connected each to a 3/2-way proportional pilot control pressure control valve 54*a* and 54*b* via control lines 53*a*, 53*b*, where the proportional magnets M1, M2 act on a pilot control valve member 55, e.g. a sliding piston.

Downstream of the pressure scale 43, one control line 56 each branches off from the pump line 48 to one of the 3/2-way proportional pilot control pressure control valves 54*a*, 54*b*, in which a screen 58 is contained, while one control line 57 each branches off from the tank line 47 to the proportional pilot control valve which contains a screen 59. The pilot control valves 54*a*, 54*b* only have to process relatively low quantities of control pressurizing agents, they are small and inexpensive, and they require only smaller and cheaper proportional magnets M1, M2 in the embodiment of FIG. 8.

In the currentless neutral position (as shown in FIG. 9), both working lines 35, 36 to the tank T are balanced, and the pressure pilot controls 52*a*, 52*b* are also balanced via the proportional pilot control valves (proportional magnets M1, M2 currentless) to the tank line 47. The control lines 56 are shut off. These positions of the proportional pilot control valves 54*a*, 54*b* are adjusted by the springs 42'.

If the proportional magnet M1 in the left of FIG. 9 is fed with current, a pressure-controlling connection from the control line 56 via the control line 53*b* to the pilot control 52*b* is opened, and the sliding piston 50 is adjusted by pressure pilot control, such that pressurizing agent flows in the working line 36 to the working port 34, and simultaneously pressurizing agent is conducted from the working port 33 to the tank T, where the pressure in the working line 36 controls the load holding valve 38 in the working line 35 to open. The hydraulic cylinder 20 is moved in the selected direction of motion at a speed corresponding to the current feed to the proportional magnet M1. To change the speed, the current feed is changed. To reverse the direction of motion of the hydraulic cylinder 20 and exactly adjust or vary the rate of motion in the other direction, the other proportional magnet M2 (in FIG. 9 on the right side), is correspondingly fed with current, so that the pilot control valve 54*a* feeds the pressure pilot control 52*a* such that the sliding piston 50 is moved via the neutral position to the other control position, and pressurizing agent flows through the working port 33 and is conducted out of the working port 34 to the tank. Analogous functions are controlled in the embodiment in FIG. 8 by the proportional magnets M1, M2 directly actuating the 4/3-way proportional pressure control valve 49.

The proportional valve technique may, alternatively, also be employed for a screed of a road finishing machine for controlling precise speed adjustments and speed changes of sections of each extension screed of the screed. There, each extension screed or extendable screed mounted to the base screed or basic screed comprises two sections which are adjustable in relation to the base screed and in relation to each other in telescopic fashion by hydraulic cylinders actuated eg via a 4/3-way proportional pressure control valve.

The invention claimed is:

1. A screed for a road finishing machine having a basic screed comprising at least one screed plate and at least one extendable screed comprising at least one screed plate, the extendable screed being connected to the basic screed and being movable linearly relative to the basic screed along a guiding device fixed to the basic screed and at least one double-actuated hydraulic cylinder connected between the extendable screed and the basic screed, for laying a payment according to at least one payment laying parameter, the at least one double-actuated hydraulic cylinder being operable to change the working width of the screed by linear movement of the extendable screed relative to the basic screed with at least one hydraulic cylinder, at least one magnetically actuated proportional directional control valve controlled by an electro-hydraulic control for controlling the direction of motion of the hydraulic cylinder and being operable to change a rate of motion of the hydraulic cylinder manually and/or automatically depending on the at least one pavement laying parameter by feeding current to the magnet of the directional control valve, and the proportional directional control valve being actuated by at least one proportional magnet with a proportional electric direction actuation by the proportional magnet or a proportional-electric-hydraulic pilot controlled actuation by the proportional magnet.

2. The screed according to claim 1, wherein the rate of motion of the hydraulic cylinder is changed proportionately to a given rate of motion and/or direction of motion of at least one moveable component of the extendable screed.

3. The screed according to claim 1, wherein the rate of motion of the hydraulic cylinder is changed independent from load acting on the hydraulic cylinder.

4. The screed according to claim 1, wherein the proportional directional control valve has a seat valve design or a sliding valve design.

5. The screed according to claim 1, wherein the proportional directional control valve is a two-way or three-way flow control valve operating with a variable control screen a cross-section of which is variable by the proportional magnet.

6. The screed according to claim 1, wherein the proportional directional control valve is a 4/3-way proportional pressure control valve having a slider valve design and a zero position open from the hydraulic cylinder to the tank, the 4/3-way proportional pressure control valve having two proportional magnets acting in opposition directions and being arranged between two working ports of the hydraulic cylinder at a hydraulic cylinder side of the 4/3-way proportional pressure control valve and having a pressure source with an associated tank at the other side of the 4/3-way proportional pressure control valve.

7. The screed according to claim 1, wherein electric proportional amplifiers are in communication with the proportional magnets of the proportional directional control valve.

8. The screed according to claim 1, wherein the electro-hydraulic control comprises a selectively activated automatic control section for linking the activation of the at least one proportional magnet with a movement control of a further moveable component of the extendable screed.

9. A road finishing machine with a screed comprising a basic screed, extendable screeds located at the basic screed and moveable in a linear direction relative to the basic screed along a guiding device fixed to the basic screed by a hydraulic cylinder controlled by an electro-hydraulic control employing at least one magnetically-actuated multi-way multi-position directional control valve for varying a working width of the screed while laying a pavement of a laying material according to at least one pavement laying parameter, wherein the multi-way/multi-position directional control valve is a proportional directional control valve actuated by at least one proportional magnet, and wherein the electro-hydraulic control is connected with the at least one proportional magnet to feed varying electric current to the proportional magnet for varying a rate of motion of the hydraulic cylinder to correspond to the at least one pavement laying parameter.

10. The screed according to claim 9, wherein the rate of motion of the hydraulic cylinder is changed proportionally to the rate of motion and/or an angle of a screed plate height adjustment drive and/or screed plate lateral inclination adjustment drive of the extendable screed.

* * * * *